US007591581B2

(12) United States Patent
Lovegrove et al.

(10) Patent No.: US 7,591,581 B2
(45) Date of Patent: Sep. 22, 2009

(54) WATCH CASE INCLUDING A STRAP CLASP

(75) Inventors: Ross Lovegrove, London (GB); Pascal Turuani, Les Fins (FR)

(73) Assignee: TAG Heuer SA, Marin (CH)

( * ) Notice: Subject to any disclaimer, the term of this patent is extended or adjusted under 35 U.S.C. 154(b) by 0 days.

(21) Appl. No.: 11/504,164

(22) Filed: Aug. 15, 2006

(65) Prior Publication Data

US 2006/0272134 A1 Dec. 7, 2006

Related U.S. Application Data

(63) Continuation of application No. PCT/EP2005/050297, filed on Jan. 24, 2005.

(30) Foreign Application Priority Data

Feb. 17, 2004 (CH) ..... 0240-04

(51) Int. Cl.
*G04B 37/00* (2006.01)

(52) U.S. Cl. ..... 368/281; 368/276

(58) Field of Classification Search ..... 368/281, 368/282; 224/152, 164, 174, 176, 179; 24/71 J
See application file for complete search history.

(56) References Cited

U.S. PATENT DOCUMENTS 1,383,968 A * 7/1921 Perry et al. ..... 368/281
1,954,249 A * 4/1934 Kehl ..... 368/281
2,892,304 A * 6/1959 Eaves ..... 368/185
4,748,604 A 5/1988 Lambert
6,311,373 B1 * 11/2001 Hashimoto ..... 24/71 J

FOREIGN PATENT DOCUMENTS

| | | |
|---|---|---|
| CH | 156 174 | 7/1932 |
| CH | 512 211 | 9/1971 |
| CH | 628 787 | 3/1982 |
| DE | 43 03 173 A1 | 8/1994 |

* cited by examiner

*Primary Examiner*—Truc T Nguyen
*Assistant Examiner*—Jason Collins
(74) *Attorney, Agent, or Firm*—Pearne & Gordon LLP

(57) ABSTRACT

Watch case comprising an unfolding clasp for a flexible strap, with the unfolding clasp comprising: a middle connected to a first end of the strap, a base connected to the second end of the strap, an extension, connected in articulated fashion to the middle and to the base. The articulations between the middle and the extension and between the base and the extension are arranged in such a manner as to allow the middle, the extension and the base to superimpose in folded position, and to be juxtaposed in an unfolded position. The watch case further comprising a regulating cam for holding by compression and/or friction the strap against the base, the cam being capable of being swung to increase or reduce in a reversible manner the length of the strap in folded position.

58 Claims, 4 Drawing Sheets

WATCH CASE INCLUDING A STRAP CLASP

REFERENCE DATA

This application is a continuation of International Patent Application PCT/EP2005/050297 (WO2005/089584) filed on Jan. 24, 2005, claiming priority of Swiss patent application 2004CH-00240 of Feb. 17, 2004, the contents whereof are hereby incorporated.

FIELD OF THE INVENTION

The present invention concerns a watch case including a strap clasp, in particular an unfolding clasp for flexible strap.

DESCRIPTION OF RELATED ART

Wristwatches generally comprise a watch case that notably contain the movement, a strap/wristlet and a strap clasp allowing the strap to be opened and closed for slipping on and slipping off the watch. The clasp is most often placed at 180° of the case along the strap. There are many types of clasps for flexible or rigid straps; it must however be admitted that unfolding clasps, that allow the strap's length to be adjusted without dissociating the two ends, give greater security.

Unfolding clasps generally comprise several metallic blades superimposed in folded position. If the blades' curve does not correspond to the wrist's diameter, these clasps can be uncomfortable. Furthermore, contact with metal both on the wrist's upper side as on its lower side increases the risk of nickel allergies for example.

Watches are also known in which the clasp is integrated in the case. The case comprises in this case several unfolding blades that are superimposed on or under the case in folded position. U.S. Pat. Nos. 4,748,604, 2,429,950 and utility model DE-U-752757 describe examples of such a clasp.

CH156174 describes another wristwatch combined with a three-bladed clasp. The middle is mounted on the intermediary blade of the clasp whilst the upper blade is formed as frame by folding above this middle. This construction is complex and widens the watch. The three parts of the clasp are clearly visible when the clasp is folded. When the clasp is entirely unfolded, the dial is turned downwards, which risks scratching the glass against the table's surface. Furthermore, the dial is read through a first glass closing the middle and a second glass connected to the frame; these two superimposed glasses make the reading poorly legible, increase the thickness of the watch and its cost. The length of the strap can be adjusted and take up several discrete positions defined by holes to engage the strap's pin; a finer, continuous adjustment is not possible.

The present invention concerns an improvement to the watch cases including an unfolding clasp.

The present invention aims in particular at improving the possibilities of personalized adjustment of the length of the flexible strap with a clasp.

The present invention also aims at providing an alternative construction of watch case including a clasp.

BRIEF SUMMARY OF THE INVENTION

The present invention thus proposes a watch case including an unfolding clasp for flexible strap that is advantageous thanks to the following features:

a middle connected to a first end of the strap, a base comprising a first extremity connected in articulated fashion to the second end of the strap, an extension connected in articulated fashion to the middle and to the base, wherein the articulations are arranged in such a manner as to allow the middle, the extension and the base to superimpose in folded position, and the middle, the extension and the base to be juxtaposed in unfolded position, a cam or regulating element to hold by compression and/or friction the strap against the base, this element being able to be swung, displaced or pivoted to increase or reduce in a reversible manner the length of the folded position of the strap.

The invention is based notably on the new observation that the watch cases combined with a clasp of known type do not allow the length of the strap to be adjusted in an entirely satisfactory fashion. The strap length regulating means are often not very convenient or require a strap shaped with a particular profile that is expensive to inject and impossible to make with certain material. Often, the length of the strap can only be adjusted by cutting the strap, which is irreversible, impossible to perform without additional tool and poorly suited to textile or leather straps for example whose extremity tends to unravel if they are cut. Other straps can only be adjusted with the aid of an additional tool necessary for removing a pin for example. Finally, watches with an unfolding clasp close to the middle and with a separate clasp, allowing the length to be adjusted, between the two extremities of the strap ends opposed to the middle are also known. These watches considerably reduce the advantages that may be expected from case-clasps.

Following a preferred embodiment of the present invention, the strap is constituted of a single piece having two extremities, having typically the shape of a band. It can be made of a material habitually used for watch straps, such as leather, textile or even, preferably, an extensible material, in particular an elastomer. According to this preferred embodiment, one of the two extremities of the strap is connected to the watch case whilst the second extremity is connected with the base.

Advantageously, the previously mentioned regulating element comprises a locking element acting by locking or pressing on a selectable portion of the strap. It can thus be implemented with any type of strap, without requiring a particular profile for the strap. However, this does not exclude the presence of such a particular profile to reinforce the locking effect, such as a relief in the shape of grooves, according notably to the nature of the material used for the strap, advantageously in the case of an elastomer.

The range of adjustment of the strap length is preferably great, for example on the order of the length of the watch case.

The particular construction proposed thus constitutes an advantageous alternative to the prior art constructions.

BRIEF DESCRIPTION OF THE DRAWINGS

The present invention will be better understood with the aid of the attached figures which show.

DETAILED DESCRIPTION OF THE INVENTION

Figure 1:
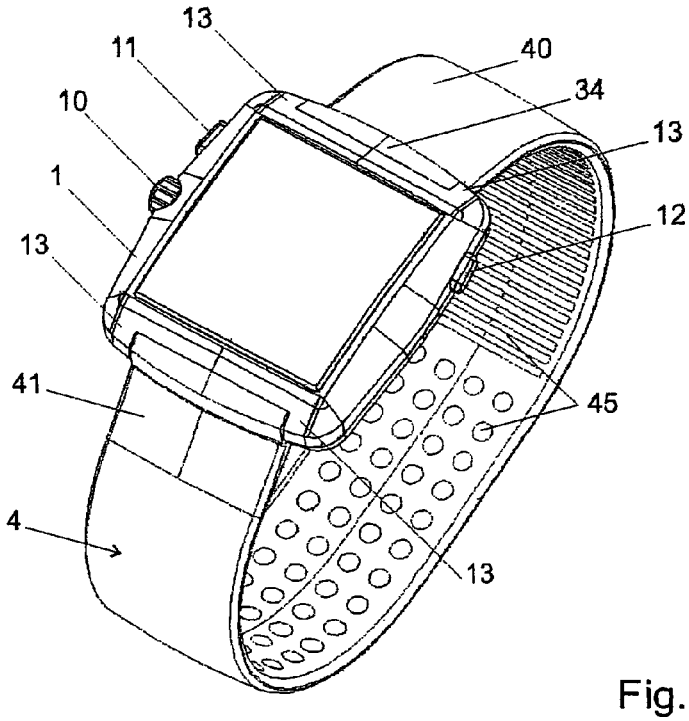
FIG. 1, a perspective view of a watch case including an unfolding clasp in folded position.

The inventive wristwatch includes a middle 1 in which a watch movement is lodged. A winding button 10 is connected to a winding shaft (not represented) and makes it possible to set the watch movement's time and/or regulate other functions.

The strap 4 of the watch is constituted of a single end whose two extremities 40 and 41 are fastened to the watch case. The extremity 41 is thus fastened, for example by means of a spring pin or other means, to the upper side at 6 o'clock of the middle 1. The other extremity 40 is fastened at 12 o'clock on a base 3 of clasp described further below. The strap is advantageously moulded or injected in a flexible and extensible material, for example in a material on the basis of silicone, in order to perfectly adapt to the wearer's wrist. A profiling 45 is preferably provided on the inside side of the strap to improve the skin's respiration and reduce sliding.

The watch case further comprises a clasp extension 2. One extremity of the extension is connected by a first hinge 20 (FIG. 4) to the lower side of the middle, at 12 o'clock, whilst the other extremity of the extension is articulated by means of a second hinge 21 with the clasp base 3 at 6 o'clock. Following an advantageous embodiment, the pivoting articulation 20 is a hinge designed for being easily disassembled in order to easily isolate the middle from the other parts of the wristwatch. This is notably useful for performing different operations, notably for casing up the movement, the dial and the hands or for performing different tests, such as tightness tests, or even for making easier different repair interventions if necessary. To this effect, the hinge 20 includes a removable pin 22, visible in FIG. 4.

Figure 2:
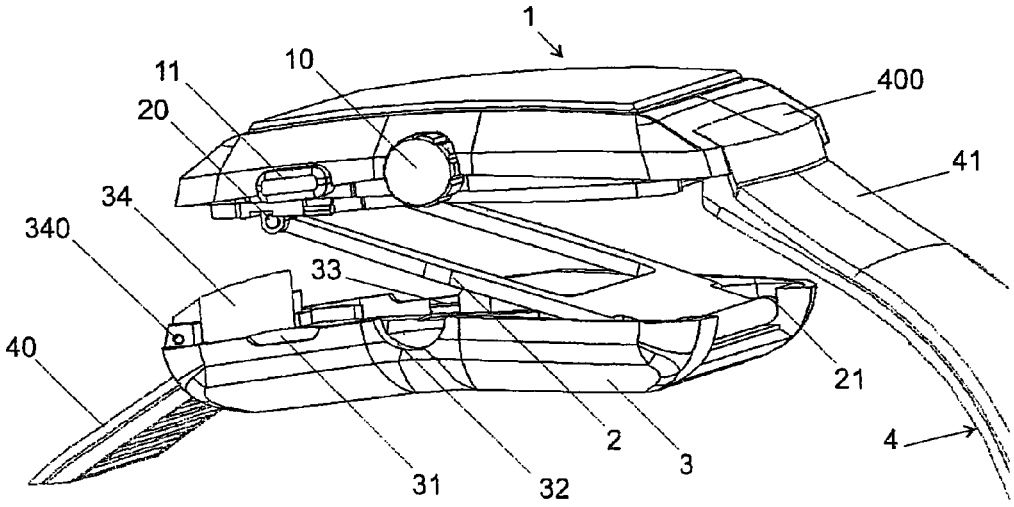
FIG. 2, a perspective view of a watch case including an unfolding clasp in partially unfolded position.

In the illustrated preferred embodiment, the extension is formed of a hollow metallic frame (stirrup), which notably allows the weight of the watch case to be reduced and the bottom of the middle 1 to be accommodated if this bottom is protruding. Preferably, as is clearly visible in particular in FIG. 2, the extension 2 has the shape of an open stirrup whose base is articulated with the base 3 through the intermediary of the hinge 21. Thus, this particular shape of extension makes it easier to lodge the extremity 40 of the strap under the middle 1. However, a clasp extension in the form of a full blade or formed itself of an elastic material can also be conceived within the frame of the invention. Furthermore, it is also possible in the frame of the invention to use clasp extensions in several elements to further increase the clasp's elongation when the clasp is opened or to improve the comfort of opening. Clasps integrated to the case of the butterfly type can thus be used.

The base 3 is designed to come and rest against the wrist when the watch is worn. The bloc middle 1—base 3 preferably forms a unit of monolithic aspect when the clasp is closed. To this effect, the base 3 and the middle fit one against the other without threshold at their junction.

The base 3 includes a recess 30 sufficiently large and deep for lodging there the entire extension 2 in a folded position. The extension 2 is thus dissimulated between the base and the middle when the watch is worn.

Figure 3:
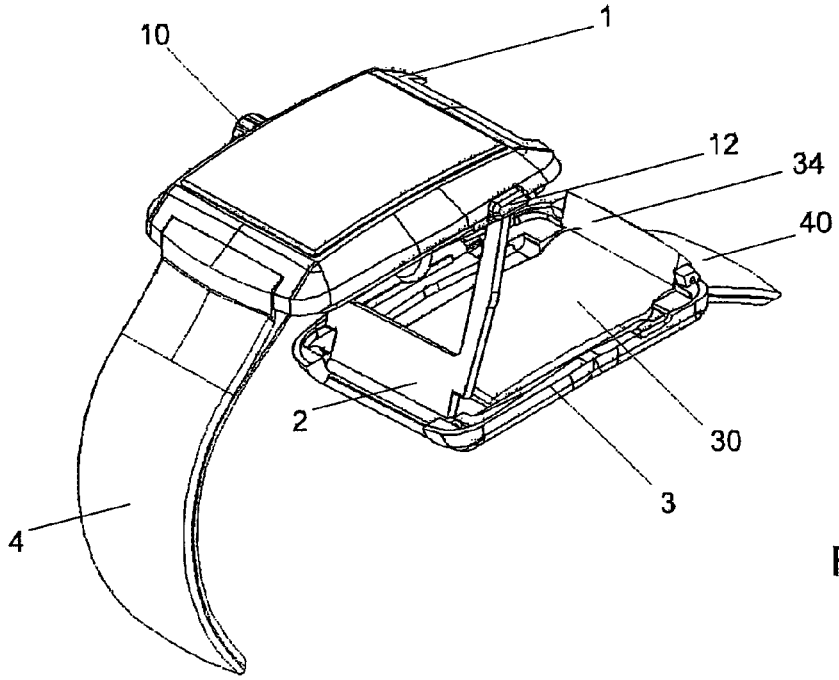
FIG. 3, a perspective view of a watch case including an unfolding clasp in intermediary position.

As can be seen in particular in FIG. 3, the recess 30 also allows the extremity 40 of the strap 4 to be lodged. The depth with which the end 40 is engaged in the recess 30 can be adjusted to regulate the useful length of the strap according to the size of the wrist. In the illustrated embodiment, the strap 4 is held in the base 3 by a two-position eccentric cam 34 that can pivot parallel to the axis 3 o'clock-9 o'clock between a position where the strap is wedged between the cam 34 and the base 3 and an adjustment position (not illustrated) where the interstice between the cam 34 and the base 3 is sufficient to have the strap 4 slide. The strap is thus held by compression of an arbitrary portion of one of its upper or lower sides and/or by friction against the elements 3 and 34. As previously mentioned, the strap is preferably of an elastic material, so that it takes up its form again when the pressure of the cam 34 is relaxed.

The cam 34 can preferably be freed only when the clasp 1, 2, 3 is open; when the watch is closed, the case 1 blocks the cam's rotation, thus preventing an accidental maladjustment of the strap's length. The cam 34 is preferably arranged in such a manner as not to be disengaged by pivoting without a certain resistance, even when the clasp is open, so as to allow the clasp to open without risk of accidentally misadjusting the strap's length. The resistance to the pivoting of the cam 34 can be for example caused by an increased compression of the strap during rotation of the cam.

In an embodiment not illustrated, the cam 34 can be released only by acting on an additional control organ, for example a push-button, or by lifting one of the portions of the strap. The cam 34 can also be constituted of several elements. The visible portion of the cam 34 preferably has the same shape and visual aspect as the extremity 400 of the strap connected to the other side of the case and thus engages between two horns 13 of the middle.

Figure 6:
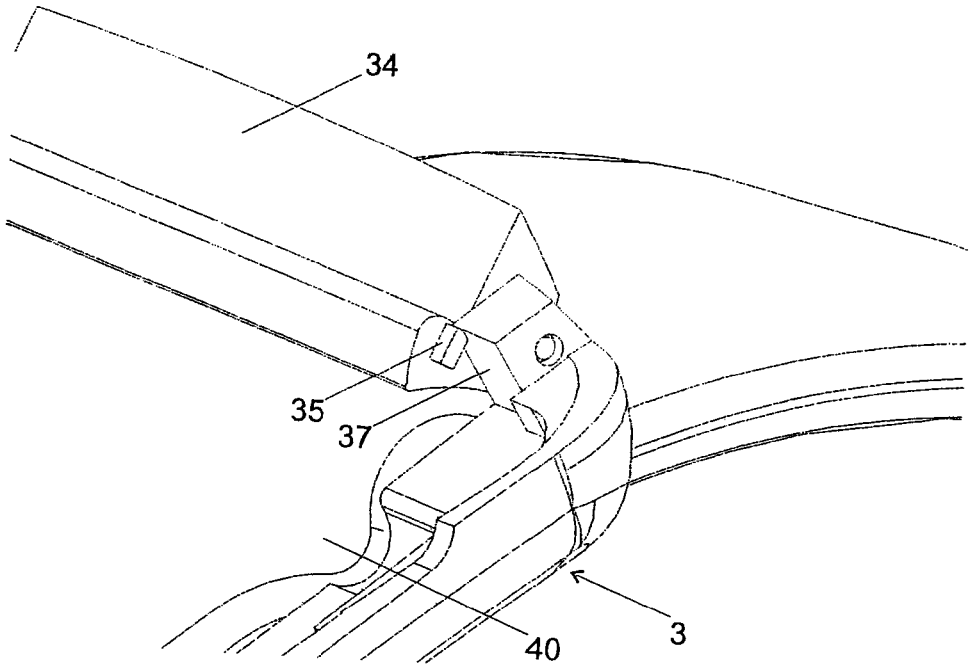
FIG. 6, another partial enlarged perspective view of the base, illustrating the regulating element in open position.
Figure 7:
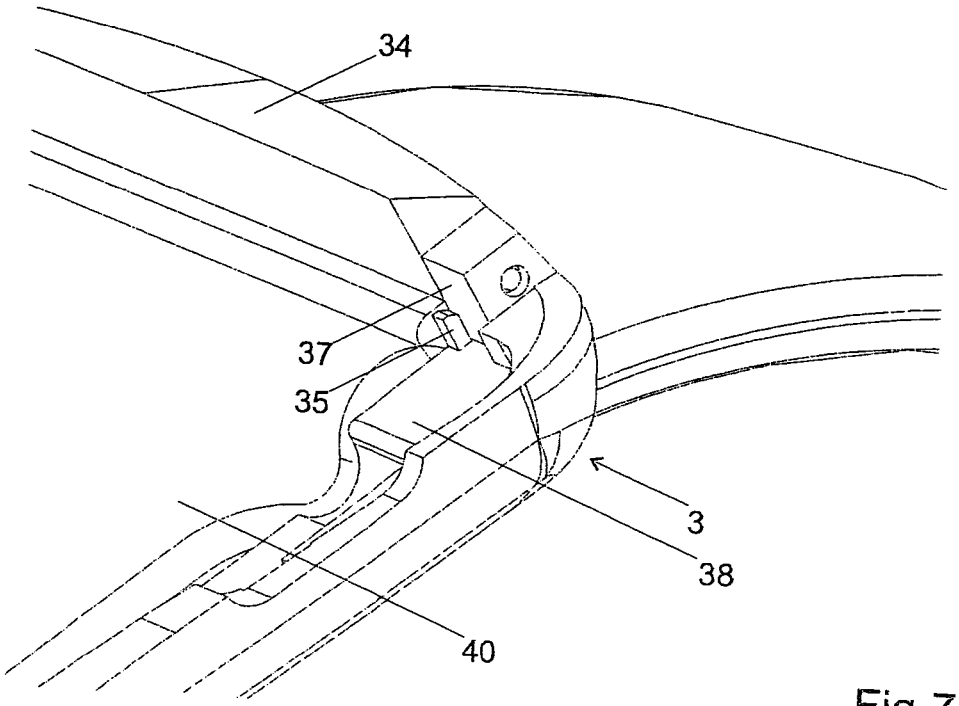
FIG. 7 corresponds to the view of FIG. 6, where the regulating element appears in closed position.

Following a preferred embodiment, at least one banking 35 works with the cam 34 to prevent the latter from rotating around its axis. Preferably, the cam's rotation angle will be limited to a value lower than 90°. By way of example visible in FIGS. 6 and 7, at least one banking 35 is borne by the cam 34 and protrudes from at least one of its extremities. As can be seen in FIG. 6, when the cam 34 is in open position, the banking 35 coming into contact with the portion 37 of the horn 37 of the base, blocks the cam's rotation. In this position, the extremity 40 of the strap can freely slide under the cam. In the closed position of the cam 34, represented in FIG. 7, the banking 35 comes into contact with the exterior edge 38 of the base 3 whilst the cam 34 immobilizes by compression the extremity 40 of the strap. It will be noted that the maximal opening of the rotation angle of the cam can be adjusted by using the banking's dimensions.

The length of the recess 30 is preferably maximal, i.e. it is equal to the length of the base 3 minus the thickness of the recess's edge. The cam 34 is placed so as to rest as far as possible from the extremity of the recess closest to the articulation 21. This particular arrangement allows the distance between the cam 34 and the bottom of the recess close to the hinge 21 to be increased and thus the range of adjustment of the strap's length to be maximized. The strap 4 is engaged under the extension 2 in the base 3; it is thus far from the bottom of the middle 1, which can be prominent according to the thickness of the used movement. Thus, the bottom of the watch/movement will not disturb the engagement of the strap.

Furthermore, the cam is arranged to exert a considerable pressure on the entire width of the strap. In this manner, the risk of the bracelet sliding outside the recess when only a small length of strap is engaged in the clasp can be minimized. By distributing the holding force of the cam 34 on the entire width of the strap, one furthermore reduces the local pressure and thus the risk of durably marking the surface of the strap. The resting surface of the base 3 on the lower side of the strap is preferably lower than the contact surface between the cam 34 and the upper side of the bracelet. This particular arrangement allows the strap to be held firmly thanks to the considerable pressure on the lower side whilst minimizing the risk of marking the strap's upper side.

Holding the strap by friction and/or compression allows the inventive watch case to be used with any type of flexible strap, including leather or textile straps in which it would be difficult to provide fastening grooves or ribs. Banking means, for example bankings working on the case and on the strap or an ardillon engaged in a hole through the strap can however also be used.

The extremity 40 of the strap 4 is connected to the base of the watch case. The traction of this extremity is thus exerted following a more or less straight comprised in the main plane of the base. Thus, the swinging torque on the case is minimal and the latter's lower side at 12 o'clock does not risk lifting even if the bracelet is worn highly tensed. The extremity 41 of the strap connected to the case is preferably bent with a step 400 so that the traction force of this extremity is also exerted along a straight close to the wrist and more or less contained in the main plane of the base 3. The lower side of the strap 4 is thus the closest to the wrist's skin on its entire length, which is more aesthetic, more comfortable and improves the watch's hold even during sudden movements.

Figure 4:
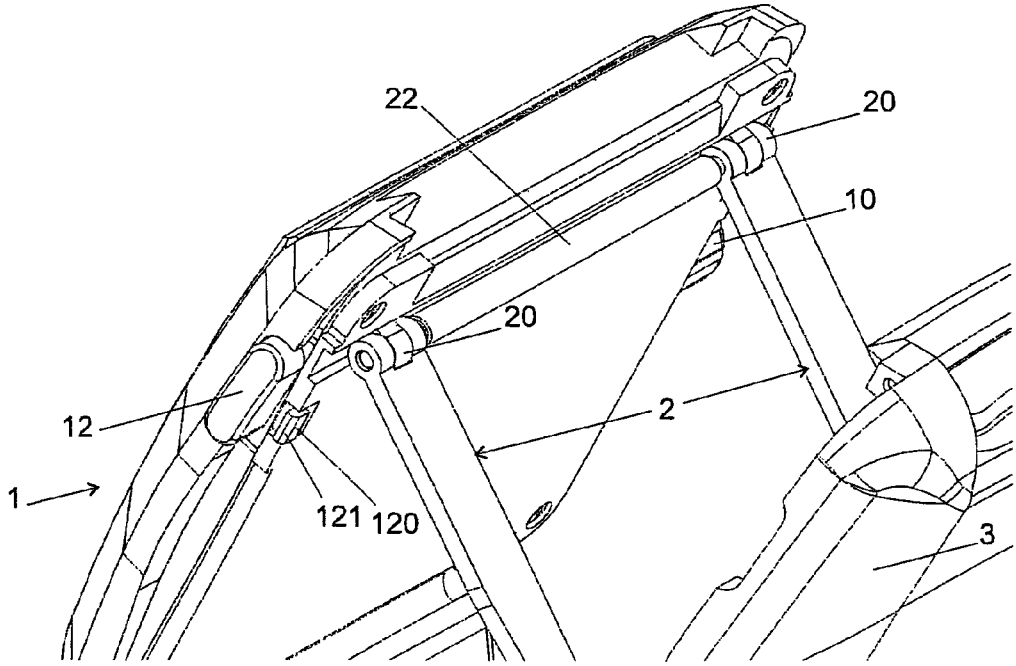
FIG. 4, a partial enlarged perspective view of a watch case including an unfolding clasp in intermediary position, illustrating in particular the articulations and locking mechanism of the middle on the base.
Figure 5:
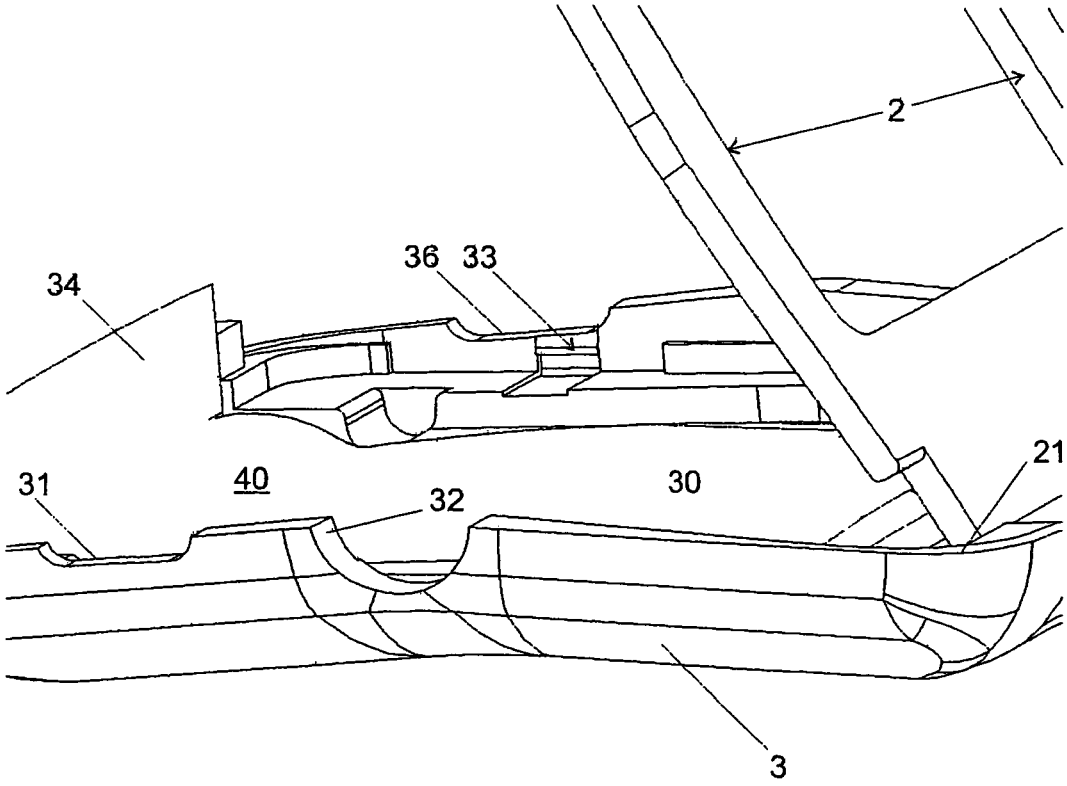
FIG. 5, another partial enlarged perspective view of a watch case including an unfolding clasp in intermediary position, illustrating in particular the locking mechanism and the notch for the winding button.

The watch case 1 comprises a mechanical locking device allowing the clasp to be locked in folded position. Said mechanical locking device can, as in the example represented in FIG. 4, comprise two push-buttons 11 and 12 capable of acting on elastically deformable elements. As can be seen in FIG. 4, the push-buttons 11 and 12 are placed on the two lateral sides of the middle 1. It can be seen that the push-button 12 allows a mobile hook 120 connected to the middle 1 and working with a banking 33 on the base to be actuated (FIG. 5). The push-button 12 can be pressed against the action of a spring or a blade, not represented, to disengage the hook 120 from the banking and thus open the clasp. A similar but symmetrical disposition is found on the other side of the case. The clasp can preferably be only opened by pressing simultaneously on the two push-buttons 11, 12 and then by lifting the middle 1 relatively to the base 3. The mobile hook 120 advantageously comprises a beveled side 121, visible in FIG. 4, allowing the clasp-case to be closed again and the hook 120 to be pushed in without having to press on the bush-button 12. A symmetrical beveled side, not represented, is also found on the hook 11.

The arrangement of the push-buttons on the middle 1 rather than on the base 3 allows them to be moved away from the wrist and thus the risk of injury to the wearer to be reduced. The winding button 10 is accessible even when the clasp is folded, so that it is not necessary to open it to set the time. According to a preferred embodiment of the invention, the winding button 10 is placed at 9 o'clock so that it cannot in any way come into contact with the back of the user's hand.

A locking of the middle 1 on the extension 2 or of the base 3 on the extension, is also conceivable within the frame of the invention. The illustrated locking of thee base on the middle however has the advantage of holding the whole case 1, 2, 3 firmly in closed position.

The base 3 comprises a semi-circular notch 32 placed opposite the winding button 10 in folded position. In the same manner, the push-buttons 11 and 12 preferably rest in notches 31 respectively 36 of the base. This particular arrangement allows the winding button and the push-buttons 11 and 12 to be placed close to the junction line between the base and the middle and thus to partially hide this line or at least to make it less visible.

The watch case that is the object of the present invention will be particularly suited to persons doing certain sports, such as golf in particular.

The invention claimed is:

1. Watch case comprising an unfolding clasp for a flexible strap, said unfolding clasp including:

a middle connected to a first extremity of the strap, a base connected to a second extremity of the strap, an extension connected in articulated fashion to the middle and to the base, wherein the articulations between the middle and the extension and between the base and the extension are arranged in such a manner as to allow the middle, the extension and the base to superimpose in folded position, and to be juxtaposed in unfolded position, and one or several regulating element(s) for increasing or reducing in a reversible manner a length of strap by said regulating element(s) directly pressing on the strap; wherein the end of the strap's end whose length is adjustable is held in said case by application of a force perpendicular to the plane of said end.

2. The watch case of claim 1, an adjustable length of said strap being engaged between the base and the extension in folded position.

3. The watch case of claim 1, wherein one of said first extremity and said second extremity has an adjustable length and is connected to said case without a pin.

4. The watch case of claim 3, wherein said one of said first extremity and said second extremity is held in said case by applying a perpendicular force to a plane of said extremity.

5. The watch case of claim 1, said strap being constituted of a single piece.

6. The watch case of claim 1, the extension being formed of an open metallic stirrup whose base is articulated with the base.

7. The watch case of claim 1, said regulating elements being arranged on said base.

8. The watch case of claim 1, the extension being hidden between the base and the middle in folded position.

9. The watch case of claim 1, a unit constituted of the middle and of the base having a monolithic aspect.

10. The watch case of claim 1, said second extremity of the strap being engaged in said watch case in folded position.

11. The watch case of claim 10, the second extremity of the strap being engaged in the base in folded position.

12. The watch case of claim 1, said strap being held by compression of an arbitrary portion of its surface against a predefined portion of said case.

13. The watch case of claim 1, said length regulating elements comprising a mobile element connected to said case resting against the strap in folded position.

14. The watch case of claim 13, the mobile element of said regulating elements being a two-position eccentric cam.

15. The watch case of claim 14, at least one banking working with the cam in order to limit the angle of rotation of said cam around its axis, at a value smaller than about 90°.

16. The watch case of claim 1, said length regulating elements being blocked when said clasp is folded.

17. The watch case of claim 1, comprising a mechanical locking device for locking the clasp in folded position.

18. The watch case of claim 17, said mechanical locking device comprising at least one push-button and at least one elastically deformable element.

19. The watch case of claim 18, said at least one pushbutton being operable against the action of a spring and allowing hooking elements connected to the middle and to the base to be engaged or disengaged.

20. The watch case of claim 18, comprising two push-buttons on each side of said case.

21. The watch case of claim 20, said push-buttons being connected to the middle.

22. The watch case of claim 18, the base comprising at least one notch for at least one said push-button when the clasp is closed.

23. The watch case of claim 1, wherein an upper side of the base has a recess for lodging said extension in folded position.

24. The watch case of claim 1, wherein an upper side of the base has a recess for lodging said second extremity of the strap in folded position, a range of adjustment of said strap being more or less equal to the length of said recess.

25. The watch case of claim 1, comprising in order the following superimposition of parts in folded position:

1) said base,
2) said second extremity of the strap,
3) said extension, and
4) said middle.

26. The watch case of claim 1, the middle comprising a winding button at about 9 o'clock, the base comprising a notch opposite said winding button when the clasp is folded.

27. The watch case of claim 1, a traction of both said extremities of the strap being exerted along two straights contained more or less in a main plane of said base.

28. The watch case of claim 1, said strap being made of extensible material.

29. Watch case comprising-an unfolding clasp for a flexible strap, said unfolding clasp including:

a middle connected to a first end of the strap,
a base connected to the second end of the strap,
an extension connected in articulated fashion to the middle and to the base, wherein the articulations between the middle and the extension and between the base and the extension are arranged in such a manner as to allow the middle, the extension and the base to superimpose in folded position, and to be juxtaposed in unfolded position, and
one or several regulating element(s) for increasing or reducing in a reversible manner a length of strap in a manner independent from said extension; wherein
the strap is held by compression of an arbitrary portion of its surface against a predefined portion of said case.

30. The watch case of claim 29, an adjustable length of said strap being engaged between the base and the extension in folded position.

31. The watch case of claim 29, wherein one of said first extremity and said second extremity has an adjustable length and is connected to said case without a pin.

32. The watch case of claim 31, wherein said one of said first extremity and said second extremity is held in said case by applying a perpendicular force to a plane of said extremity.

33. The watch case of claim 29, said strap being constituted of a single piece.

34. The watch case of claim 29, the extension being formed of an open metallic stirrup whose base is articulated with the base.

35. The watch case of claim 29, said regulating elements being arranged on said base.

36. The watch case of claim 29, the extension being hidden between the base and the middle in folded position.

37. The watch case of claim 29, a unit constituted of the middle and of the base having a monolithic aspect.

38. The watch case of claim 29, said second extremity of the strap being engaged in said watch case in folded position.

39. The watch case of claim 38, the second extremity of the strap being engaged in the base in folded position.

40. The watch case of claim 29, said strap being held by compression of an arbitrary portion of its surface against a predefined portion of said case.

41. The watch case of claim 29, said length regulating elements comprising a mobile element connected to said case resting against the strap in folded position.

42. The watch case of claim 41, the mobile element of said regulating elements being a two-position eccentric cam.

43. The watch case of claim 42, at least one banking working with the cam in order to limit the angle of rotation of said cam around its axis, at a value smaller than about 90°.

44. The watch case of claim 29, said length regulating elements being blocked when said clasp is folded.

45. The watch case of claim 29, comprising a mechanical locking device for locking the clasp in folded position.

46. The watch case of claim 45, said mechanical locking device comprising at least one push-button and at least one elastically deformable element.

47. The watch case of claim 46, said at least one pushbutton being operable against the action of a spring and allowing hooking elements connected to the middle and to the base to be engaged or disengaged.

48. The watch case of claim 46, comprising two push-buttons on each side of said case.

49. The watch case of claim 48, said push-buttons being connected to the middle.

50. The watch case of claim 46, the base comprising at least one notch for at least one said push-button when the clasp is closed.

51. The watch case of claim 29, wherein an upper side of the base has a recess for lodging said extension in folded position.

52. The watch case of claim 29, wherein an upper side of the base has a recess for lodging said second extremity of the strap in folded position, a range of adjustment of said strap being more or less equal to the length of said recess.

53. The watch case of claim 29, comprising in order the following superimposition of parts in folded position:

1) said base,
2) said second extremity of the strap,
3) said extension, and
4) said middle.

54. The watch case of claim 29, the middle comprising a winding button at about 9 o'clock, the base comprising a notch opposite said winding button when the clasp is folded.

55. The watch case of claim 29, a traction of both extremities of the strap being exerted along two straights contained more or less in a main plane of said base.

56. The watch case of claim 29, said strap being made of extensible material.

57. Watch case comprising an unfolding clasp for a flexible strap, said unfolding clasp including:

a middle connected to a first end of the strap,
a base connected to the second end of the strap,
an extension connected in articulated fashion to the middle and to the base, wherein
the articulations between the middle and the extension and between the base and the extension are arranged in such a manner as to allow the middle, the extension and the base to superimpose in folded position, and to be juxtaposed in unfolded position, and one or several regulating element(s) in direct contact with the strap for increasing or reducing in a reversible manner a length of measured strap; wherein said length regulating elements are blocked when said clasp is folded.

58. Watch case comprising an unfolding clasp for a flexible strap, said unfolding clasp including:

a middle connected to a first end of the strap, a base connected to the second end of the strap, an extension connected in articulated fashion to the middle and to the base, wherein the articulations between the middle and the extension and between the base and the extension are arranged in such a manner as to allow the middle, the extension and the base to superimpose in folded position, and to be juxtaposed in unfolded position, one or several regulating element(s) for increasing or reducing in a reversible manner a length of said strap by said one or several regulating elements directly pressing on the strap, wherein an end of the strap is held in said case by application of a force perpendicular to a plane of said end;

a mechanical locking device comprising at least one push-button placed on a lateral side of the middle, the push-button being capable of being actuated against the action of a spring to disengage at least one hooking element connected to the middle and to the base to be engaged and disengaged, said at least one hooking element being placed in laterally de-centered fashion.

* * * * *